US005487763A

United States Patent [19]

More et al.

[11] Patent Number: 5,487,763

[45] Date of Patent: Jan. 30, 1996

[54] FUEL COMPOSITIONS

[75] Inventors: Iain More, Abingdon; Kenneth Lewtas; Jacqueline D. Bland, both of Wantage; Sally J. Ayres, Stanton Harcourt, all of United Kingdom

[73] Assignee: Exxon Chemical Patents Inc., Linden, N.J.

[21] Appl. No.: 393,521

[22] Filed: Feb. 23, 1995

Related U.S. Application Data

[63] Continuation of Ser. No. 71,905, Jun. 2, 1993, abandoned, which is a continuation of Ser. No. 539,586, Jun. 18, 1990, abandoned, which is a continuation of Ser. No. 356,749, May 24, 1989, abandoned, which is a continuation of Ser. No. 166,708, Mar. 11, 1988, abandoned.

[30] Foreign Application Priority Data

Mar. 12, 1987 [GB] United Kingdom ..... 8705839

[51] Int. Cl.$^6$ ..... C10L 1/18

[52] U.S. Cl. ..... 44/393; 44/395; 44/396

[58] Field of Search ..... 44/389, 393, 396, 44/395

[56] References Cited

U.S. PATENT DOCUMENTS

| | | | |
|---|---|---|---|
| 4,087,255 | 5/1978 | Wisotsky et al. | 44/389 |
| 4,217,534 | 7/1980 | Feldman | 44/393 |
| 4,661,121 | 4/1987 | Lewtas | 44/389 |
| 4,661,122 | 4/1987 | Lewtas | 44/389 |
| 4,713,088 | 12/1987 | Jack et al. | 44/389 |

FOREIGN PATENT DOCUMENTS

| | | |
|---|---|---|
| 0802598 | 10/1958 | United Kingdom . |
| 1196226 | 6/1970 | United Kingdom . |
| 1593672 | 7/1981 | United Kingdom . |

*Primary Examiner*—Jacqueline V. Howard
*Attorney, Agent, or Firm*—John J. Mahon

[57] ABSTRACT

Additives for distillate fuel are a copolymer of (1) an alpha olefin having two to seventeen carbon atoms per molecule or an aromatic substituted olefin having eight to forty carbon atoms per molecule and (2) a mono- or di-alkyl fumarate, itaconate, citraconate, mesaconate, trans- or cis-glutaconate, in which the alkyl group has 8 to 23 carbon atoms.

8 Claims, No Drawings

FUEL COMPOSITIONS

This is a continuation of application Ser. No. 071,905, filed Jun. 2, 1993, which is a R60 continuation of U.S. Ser. No. 539,586, filed Jun. 18, 1990, which is a R60 continuation of U.S. Ser. No. 356,749 filed May 24, 1989, which is a R 60 of U.S. Ser. No. 166,708 filed Mar. 11, 1988, which is based on UK Patent Application 87-05839 filed Mar. 12, 1987, all now abandoned.

This invention concerns fuel compositions containing a cold flow improver.

Mineral oils containing paraffin wax such as the distillate fuels used as diesel fuel and heating oil have the characteristic of becoming less fluid as the temperature of the oil decreases. This loss of fluidity is due to the crystallisation of the wax into plate-like crystals which eventually form a spongy mass entrapping the oil therein, the temperature at which the wax crystals begin to form being known as the Cloud Point, the temperature at which the wax prevents the oil pouring is known as the Pour Point.

It has long been known that various additives act as Pour Point depressants when blended with waxy mineral oils. These compositions modify the size and shape of wax crystals and reduce the cohesive forces between the crystals and between the wax and the oil in such as manner as to permit the oil to remain fluid at a lower temperature so being pourable and able to pass through coarse filters.

Various Pour Point depressants have been described in the literature and several of these are in commercial use. For example, U.S. Pat. No. 3,048,479 teaches the use of copolymers of ethylene and $C_1$–$C_5$ vinyl esters, e.g. vinyl acetate, as pour depressants for fuels, specifically heating oils, diesel and jet fuels. Hydrocarbon polymeric pour depressants based on ethylene and higher alpha-olefins, e.g. propylene, are also known.

U.S. Pat. No. 3,961,916 teaches the use of a mixture of copolymers, to control the size of the wax crystals and United Kingdom Patent 1,263,152 suggests that the size of the wax crystals may be controlled by using a copolymer having a low degree of side chain branching. Both systems improve the ability of the fuel to pass through filters as determined by the Cold Filter Plugging Point (CFPP) test since instead of plate like crystals formed without the presence of additives the needle shaped wax crystals produced will not block the pores of the filter rather forming a porous cake on the filter allowing passage of the remaining fluid.

Other additives have also been proposed for example, United Kingdom Patent 1,469,016, suggests that the copolymers of di-n-alkyl fumarates and vinyl acetate which have previously been used as pour depressants for lubricating oils may be used as co-additives with ethylene/vinyl acetate copolymers in the treatment of distillate fuels with high final boiling points to improve their low temperature flow properties. European Patent Publications 0153177, 0153176, 0155807 and 0156577 disclose improvements in such di-n-alkyl fumarates.

U.S. Pat. No. 3,252,771 relates to the use of polymers of $C_{16}$ to $C_{18}$ alpha-olefins obtained by polymerisation with aluminium trichloride/alkyl halide catalysts as pour depressants in distillate fuels of the broad boiling, easy-to-treat types available in the United States in the early 1960's.

It has also been proposed to use additives based on olefin/maleic anhydride copolymers. For example, U.S. Pat. No. 2,542,542 uses copolymers of olefins such as octadecene with maleic anhydride esterified with an alcohol such as lauryl alcohol as pour depressants and United Kingdom Patent 1,468,588 uses copolymers of $C_{22}$–$C_{28}$ olefins with maleic anhydride esterified with behenyl alcohol as co-additives for distillate fuels.

Similarly, Japanese Patent Publication 5,654,037 uses olefin/maleic anhydride copolymers which have been reacted with amines such as pour depressants and in Japanese Patent Publication 5,654,038 the derivatives of the olefin/maleic anhydride copolymers are used together with conventional middle distillate flow improvers such as ethylene vinyl acetate copolymers.

Japanese Patent Publication 5,540,640 discloses the use of olefin/maleic anhydride copolymers (not esterified) and states that the olefins used should contain more than 20 carbon atoms to obtain CFPP activity.

United Kingdom 2,192,012 uses mixtures of esterified olefin/maleic anhydride copolymers and low molecular weight polyethylene, the esterified copolymers being ineffective when used as sole additives. The patent specifies that the olefin should contain 10–30 carbon atoms and the alcohol 6–28 carbon atoms with the longest chain in the alcohol containing 22–40 carbon atoms. European Patent Publication 0214786 discloses improvements in such esterified olefin/maleic anhydride copolymers.

U.S. Pat. Nos. 3,444,082; 4,211,534; 4,375,973 and 4,402,708 suggest the use of certain nitrogen containing compounds.

The esterified maleic anhydride copolymers are however difficult to produce since the maleic anhydride copolymers are difficult to fully esterify due to steric problems whilst it is not possible to effectively copolymerise the long chain maleic esters with styrene or longer chain olefins which can give performance debits. These problems may be overcome by the present invention.

According to this invention a fuel composition comprises a major proportion by weight of a distillate fuel oil and a minor proportion by weight of a copolymer of (1) a $C_2$ to $C_{17}$ alpha olefin or an aromatic substituted olefin having eight for forty carbon atoms per molecule and (2) an ester, said ester being a mono- or di-alkyl fumarate, itaconate, citraconate, mesaconate, trans- or cis-glutaconate, in which the alkyl group has 8 to 23 carbon atoms.

This invention also provides the use as a cold flow improver in a distillate fuel oil of a copolymer of (1) a $C_2$ to $C_{17}$ alpha olefin or an aromatic substituted olefin having eight to forty carbon atoms per molecule and (2) an ester, said ester being a mono- or di-alkyl fumarate, itaconate, citraconate, mesaconate, trans- or cis-glutaconate, in which the alkyl group has 8 to 23 carbon atoms.

The distillate fuel can be for example the middle distillate fuel oils, e.g. a diesel fuel, aviation fuel, kerosene, fuel oil, jet fuel, heating oil etc. Generally, suitable distillate fuels are those boiling in the range of 120° to 500° C. (ASTM D1160), preferably those boiling on the range 150° to 400° C., for example, those having a relatively high final boiling point (FBP) of above 360° C. A representative heating oil specification calls for a 10 percent distillation point no higher than about 226° C., a 50 percent point no higher than about 272° C. and a 90 percent point of at least 282° C. and no higher than about 338° C. to 343° C., although some specifications set the 90 percent point as high as 357° C. Heating oils are preferably made of a blend of virgin distillate, e.g. gas oil, naphtha, etc. and cracked distillates, e.g. catalytic cycle stock. A representative specification for a diesel fuel includes a minimum flash point of 38° C. and a 90 percent distillation point between 282° C. and 338° C. (See ASTM Designation D-396 and D-975).

The copolymer which is included as a minor proportion by weight in the fuel compositions of this invention may be a copolymer of a $C_2$ to $C_{17}$ alpha olefin and a certain specified ester. Thus suitable olefins are those of the formula $R—CH{=}CH_2$ where R is a hydrogen or an alkyl group of 1 to 15 carbon atoms. It is preferred that the alkyl group be straight-chained and not branched. Suitable alpha olefins therefore include ethylene, propylene, n-butene, n-octene, n-decene, n-tetradecene and n-hexadecene. Alpha olefins having 12 to 17 carbon atoms per molecule are particularly preferred. If desired mixtures of $C_2$ to $C_{17}$ olefins may be copolymerised with the alkyl fumarate.

Alternatively the copolymer may be derived from one of the above mentioned esters and an aromatic substituted olefin having eight to forty carbon atoms per molecule. The aromatic substituent may be naphthalene or a substituted, e.g. alkyl or halogen substituted, naphthalene but is preferably a phenyl substituent. Particularly preferred monomers are styrene, α- and β-alkyl styrenes, such as α-methyl styrene, α-ethyl styrene. Styrene or the alkyl styrene may have substituents, e.g. alkyl groups or halogen atoms on the benzene ring of the molecule. In general substituents in the benzene ring are alkyl groups having 1 to 20 carbon atoms.

The alkyl fumarate, itaconate, citraconate, mesaconate, trans- or cis-glutaconate with which the olefin is copolymerised is preferably a dialkyl ester, e.g. fumarate, but mono-alkyl esters, e.g. fumarates, are suitable. The alkyl group has to have 8 to 23 carbon atoms. The alkyl group is preferably straight chain although if desired branched chain alkyl groups can be used. Suitable alkyl groups are decyl, dodecyl, tetradecyl, hexadecyl, octadecyl, eicosyl, behenyl or mixtures thereof. Preferably the alkyl group contains 10 to 18 carbon atoms. If desired the two alkyl groups of the dialkyl fumarate or other ester can be different, e.g. one tetradecyl and the other hexadecyl.

The copolymerisation can be conveniently effected by mixing the olefin, olefin mixture, or aromatic substituted olefin and ester, e.g. fumarate, usually in about equimolar proportions and heating the mixture to a temperature of at least 80° C., preferably at least 120° C. in the presence of a free radical polymerisation promoter such as t-butyl hydroperoxide, di-t-butyl peroxide or t-butyl peroctoate. Alternatively the olefin, olefin mixture or aromatic substituted olefin and acid, e.g. fumaric acid, may be copolymerised and the copolymer esterified with the appropriate alcohol to form the alkyl groups in the copolymer. The properties of the copolymer and its performance can depend upon its manufacture. For example continuous addition of styrene or the olefine to a solution of the fumarate ester can produce a polymer having different properties and additive performance than polymers produced without solvent or with all the styrene or olefine added at the start of polymerisation.

In general the molar proportion of olefin, olefin mixture or aromatic substituted olefin to fumarate is between 1:1.5 and 1.5:1, preferably between 1:1.2 and 1.2:1, e.g. about 1:1.

The number average molecular weight of the copolymer (measured by gel permeation chromatography (GPC) relative to polystyrene standard) is usually between 2,000 and 100,000, preferably between 5,000 and 50,000.

Improved results are often achieved when the fuel compositions of this invention contain other additives known for improving the cold flow properties of distillate fuels generally. Examples of these other additives are the polyoxyalkylene esters, ethers, ester/ethers amide/esters and mixtures thereof, particularly those containing at least one, preferably at least two $C_{10}$ to $C_{30}$ linear saturated alkyl groups of a polyoxyalkylene glycol group of molecular weight 100 to 5,000 preferably 200 to 5,000, the alkylene group in said polyoxyalkylene glycol containing from 1 to 4 carbon atoms. European Patent Publication 0,061,895 A2 describes some of these additives.

The preferred esters, ethers or ester/ethers may be structurally depicted by the formula:

$$R—O—(A)—O—R'$$

where R and R' are the same or different and may be i) n-alkyl ii) $\text{n-alkyl-C}(=O)—$ iii) $\text{n-alkyl-C}(=O)—(CH_2)_n—$ or iv) $\text{n-alkyl-C}(=O)—(CH_2)_n—C(=O)—$ the alkyl group being linear and saturated and containing 10 to 30 carbon atoms, and A represents the polyoxyalkylene segment of the glycol in which the alkylene group has 1 to 4 carbon atoms, such as polyoxymethylene, polyoxyethylene or polyoxytrimethylene moiety which is substantially linear; some degree of branching with lower alkyl side chains (such as in polyoxypropylene glycol) may be tolerated but it is preferred the glycol should be substantially linear. Suitable glycols generally are the substantially linear polyethylene glycols (PEG) and polypropylene glycols (PPG) having a molecular weight of about 100 to 5,000, preferably about 200 to 2,000. Esters are preferred and fatty acids containing from 10–30 carbon atoms are useful for reacting with the glycols to form the ester additives and it is preferred to use a $C_{18}$–$C_{24}$ fatty acid, especially behenic acids. The esters may also be prepared by esterifying polyethoxylated fatty acids or polyethoxylated alcohols.

Other suitable additives for fuel composition of this invention are ethylene unsaturated ester copolymer flow improvers. The unsaturated monomers which may be copolymerised with ethylene include unsaturated mono and diesters of the general formula:

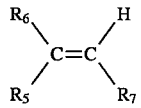

wherein $R_6$ is hydrogen or methyl, $R_5$ is a $—OOCR_8$ group wherein $R_8$ is hydrogen or a $C_1$ to $C_{28}$, more usually $C_1$ to $C_{17}$, and preferably a $C_1$ to $C_8$, straight or branched chain alkyl group; or $R_5$ is a $—COOR_8$ group wherein $R_8$ is as previously defined but is not hydrogen and $R_7$ is hydrogen or $—COOR_8$ as previously defined. The monomer, when $R_5$ and $R_7$ are hydrogen and $R_6$ is $—OOCR_8$, includes vinyl alcohol esters of $C_1$ to $C_{29}$, more usually $C_1$ to $C_{18}$, monocarboxylic acid, and preferably $C_2$ to $C_5$ monocarboxylic acid. Examples of vinyl esters which may be copolymerised with ethylene include vinyl acetate, vinyl propionate and vinyl butyrate or isobutyrate, vinyl acetate being preferred. It is preferred that the copolymers contain from 20 to 40 wt % of the vinyl ester, more preferably from 25 to 35 wt % vinyl ester. They may also be mixtures of two copolymers such as those described in U.S. Pat. No. 3,961,916. It is preferred that these copolymers have a number average molecular weight as measured by vapour phase osmometry of 1,000 to 6,000, preferably 1,000 to 3,000.

Other suitable additives for fuel compositions of the present invention are polar compounds, either ionic or non-ionic, which have the capability in fuels of acting as wax crystal growth inhibitors. Polar nitrogen containing compounds have been found to be especially effective when used in combination with the glycol esters, ethers or ester/ethers. These polar compounds are generally amine salts and/or amides formed by reaction of at least one molar proportion of hydrocarbyl substituted amines with a molar proportion of hydrocarbyl acid having 1 to 4 carboxylic acid groups or their anhydrides; ester/amides may also be used containing 30 to 300, preferably 50 to 150 total carbon atoms. These nitrogen compounds are described in U.S. Pat. No. 4,211,534. Suitable amines are usually long chain $C_{12}$–$C_{40}$ primary, secondary, tertiary or quaternary amines or mixtures thereof but shorter chain amines may be used provided the resulting nitrogen compound is oil soluble and therefore normally containing about 30 to 300 total carbon atoms. The nitrogen compound preferably contains at least one straight chain $C_8$–$C_{40}$, preferably $C_{14}$ to $C_{24}$ alkyl segment.

Suitable amines include primary, secondary, tertiary or quaternary, but preferably are secondary. Tertiary and quaternary amines can only form amine salts. Examples of amines include tetradecyl amine, cocoamine, hydrogenated tallow amine and the like. Examples of secondary amines include dioctacedyl amine, methyl-behenyl amine and the like. Amine mixtures are also suitable and many amines derived from natural materials are mixtures. The preferred amine is a secondary hydrogenated tallow amine of the formula $HNR_1R_2$ wherein $R_1$ and $R_2$ are alkyl groups derived from hydrogenated tallow fat composed of approximately 4% $C_{14}$, 31% $C_{16}$, 59% $C_{18}$.

Examples of suitable carboxylic acids for preparing these nitrogen compounds (and their anhydrides) include cyclohexane, 1,2 dicarboxylic acid, cyclohexane dicarboxylic acid, cyclopentane 1,2 dicarboxylic acid, naphthalene dicarboxylic acid and the like. Generally, these acids will have about 5–13 carbon atoms in the cyclic moiety. Preferred acids are benzene dicarboxylic acids such as phthalic acid, tera-phthalic acid, and iso-phthalic acid. Phthalic acid or its anhydride is particularly preferred. The particularly preferred compound is the amide-amine salt formed by reacting 1 molar portion of phthalic anhydride with 2 molar portions of di-hydrogenated tallow amine. Another preferred compound is the diamide formed by dehydrating this amide-amine salt Alternatively the nitrogen compound may be a compound of the general formula

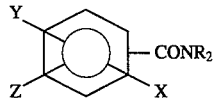

where X is $CONR_2$ $CO_2$— $^+H_2NR_2$ Y and Z are $CONR_2$, $CO_2R$, OCOR, —OR, —R, —NCOR one of Y or Z may be zero and R is alkyl, aloxy alkyl or polyalkoxyalkyl as described in European Application 87311160.3.

The Additives of the present invention may also be used in combination with the sulpho carboxy materials described in our pending European patent application number 87 308436.2 which claims use of compounds of the general formula:

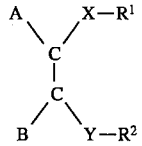

in which —Y—$R^2$ is $SO_3(-)$ $(+)H_2NR^3R^2$,

—$SO_3^{(-)(+)}H_3NR^2$,

—$SO_2NR^3R^2$ or —$SO_3R^2$;

—X—$R^1$ is —Y—$R^2$ or —$CONR_3R^1$,

—$CO^{2(-)(+)}NR^3R^1$, —$CO_2^{(-)(+)}HNR^3R^1$,

—$R^4$—$COOR_1$, —$NR^3COR^1$, $R^4OR^1$, —$R^4OCOR^1$, —$R^4R^1$,

—$N(COR^3)R^1$ or $Z^{(-)(+)}NR^3R^1$;

—$Z^{(-)}$ is $SO_3^{(-)}$ or —$CO_2^{(-)}$;

$R^1$ and $R^2$ are alkyl, alkoxy alkyl or polyalkoxy alkyl containing at least 10 carbon atoms in the main chain;

$R^3$ is hydrocarbyl and each $R^3$ may be the same or different and $R^4$ is nothing or is $C_1$ to $C_5$ alkylene and in

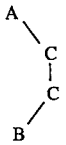

the carbon-carbon (C—C) bond is either a) ethylenically unsaturated when A and B may be alkyl, alkenyl or substited hydrocarbyl groups or b) part of a cyclic structure which may be aromatic, polynuclear aromatic or cyclo-aliphatic, it is preferred that X—$R^1$ and Y—$R^2$ between them contain at least three alkyl, alkoxyalkyl or polyalkoxyalkyl groups.

The relative proportions of additives used in the mixtures are preferably from 0.05 to 10 parts by weight more preferably from 0.1 to 5 parts by weight of the alpha olefin- or aromatic substituted olefin-ester copolymer to 1 part of the other additives such as the polyoxyalkylene esters, ether or ester/ether.

The amount of polymer added to the distillate fuel oil is preferably 0.0001 to 5.0 wt %, for example, 0.001 to 0.5 wt % (active matter) based on the weight of distillate fuel oil.

The alpha olefin- or aromatic substituted olefin-ester copolymer may conveniently be dissolved in a suitable solvent to form a concentrate of from 20 to 90, e.g. 30 to 80 weight % of the copolymer in the solvent. Suitable solvents include kerosene, aromatic naphthas, mineral lubricating oils etc. The concentrate may also contain other additives.

EXAMPLE 1

In this example distillate fuel oil compositions were prepared and subjected to Cold Filter Plugging Point tests. One copolymer (M) which was used was a copolymer of n-hexadecene-1 and di-n-tetradecyl fumarate, the mole ratio of hexadecene to fumarate being 1:1. Its number average molecular weight (measure by GPC relative to polystyrene standard) was about 8200. For one of the tests copolymer (M) was blended with an ethylene-vinyl acetate copolymer mixture (X), details of which are as follows:

The copolymer mixture was a 3:1 (by weight) mixture of respectively an ethylene-vinyl acetate copolymer containing about 36 wt % vinyl acetate of number average molecular weight 2000 and an ethylene-vinyl acetate copolymer containing about 17 wt % vinyl acetate of number average molecular weight 3000.

For another test copolymer (M) was blended with the dibehenate of a polyethylene glycol (Y) having an average molecular weight of about 600. The additives were added separately to two different distillate fuel oils A and B which had the following characteristics:

| Fuel | | | ASTM D86 Distillation (°C.) | | | | |
|---|---|---|---|---|---|---|---|
| oil | WAT[a] | Wax Content[b] | IBP | 20% | 50% | 90% | FBP |
| A | −1.0 | 0.9 | 184 | 226 | 272 | 368 | 398 |
| B | +4.6 | 8.4 | 214 | 258 | 280 | 326 | 352 |

[a]Wax appearance temperature (°C.)
[b]Weight percent of wax in fuel oil which precipitates when the temperature of the fuel oil is 10° C. below its WAT.

For comparison purposes copolymer (X) alone was added to fuel oil A. Also a hexadecene-ditetradecyl maleate copolymer (N) blended with (X) and with (Y) was added to the fuel oils.

The results obtained are given below:

| Fuel | Additive | Treat rate ppm (active ingredient) | CFPP (°C.) |
|---|---|---|---|
| A | M:X (ratio 1:4) | 175 | 21 |
| | " | 300 | 22 |
| A | N:X (ratio 1:4) | 175 | 20 |
| | " | 300 | 23 |
| A | X | 300 | 3 |
| B | M:Y (ratio 4:1) | 750 | 1 |
| | " | 1500 | 1 |
| B | N:Y (ratio 4:1) | 750 | 0.5 |
| | " | 1500 | 0.5 |

Thus it can be seen that in general superior results as regards CFPP are achieved with the compositions of the invention (tests 1 and 4). Details of the CFPPT are as follows:

The Cold Filter Plugging Point Test (CFPPT)

The cold flow properties of the blend were determined by the Cold Filter Plugging Point Test (CFPPT). This test is carried out by the procedure described in 52, No. 510, June 1966 pp. 173–185. In brief, a 40 ml sample of the oil to be tested is cooled by a bath maintained at about −34° C. Periodically (at each one degree centrigrade drop in temperature starting from 2° C. above the cloud point) the cooled oil is tested for its ability to flow through a fine screen in a time period. This cold property is tested with a device consisting of a pipette to whose lower end is attached an inverted funnel positioned below the surface of the oil to be tested. Stretched across the mouth of the funnel is a 350 mesh screen having an area of about 0.45 square inch. The periodic tests are each initiated by applying a vacuum to the upper end of the pipette whereby oil is drawn through the screen up into the pipette to a mark indicating 20 ml. of oil. The test is repeated with each one degree drop in temperature until the oil fails to fill the pipette to a mark indicating 20 ml of oil. The test is repeated with each one degree drop in temperature until the oil fails to fill the pipette within 60 seconds. The results of the test are quoted as CFPP (°C.) which is the difference between the fail temperature of the untreated fuel ($CFPP_o$) and the fuel treated with the polymer ($CFPP_1$) i.e. $\Delta CFPP = CFPP_0 - CFPP_1$

EXAMPLE 2

A copolymer of styrene and di-tetradecyl fumarate additive (P) having a number average molecular weight of 9500 and a weight average molecular weight of 24,200 (both measured by GPC relative to polystyrene standard) was separately blended in two distillate fuels C and D together with other additives. These additives were additive (X) (Example 1), and a copolymer of styrene and di-tetradecyl maleate (additive (Y)) having a number average molecular weight (measured by GPC relative to polystyrene standard) of about 10,000.

The two distillate fuels C and D had the following properties:

| | | ASTM D86 Distillation (°C.) | | | |
|---|---|---|---|---|---|
| Fuel | IBP | 20% | 50% | 90% | FBP |
| C | 184 | 223 | 267 | 367 | 398 |
| D | 166 | 211 | 251 | 334 | 376 |

As with Example 1 Cold Filter Plugging Point Tests were carried out and the results obtained were as follows:

| Fuel | Additive (X) ppm (active ingredient) | Additive (P) ppm (active ingredient) | Additive (Y) ppm (active ingredient) | CFPP (°C.) |
|---|---|---|---|---|
| C | 90 | 500 | — | 17.5 |
| D | — | 500 | — | 3.5 |
| D | — | — | 500 | 2.0 |
| D | 45 | 500 | — | 14.0 |

It is seen that the results obtained using additive (P) are at least as good as those achieved using the prior art additive (Y).

EXAMPLE 3

In this example the performance of the fuels was determined in the Programmed Cooling Test in which the cold flow properties of the described fuels containing the additives were determined as follows. 300 ml. of fuel are cooled linearly at 1° C./hour to the test temperature and the temperature then held constant. After 2 hours at −9° C., approximately 20 ml. of the surface layer is removed as the abnormally large wax crystals which tend to form on the oil/air interface during cooling. Wax which has settled in the bottle is dispersed by gentle stirring, then a Cold Filter Plugging Point CFPP filter assembly which is described in detail in "Journal of the Institute of Petroleum", Volume 52, Number 510, June 1966, pp. 173–285 is inserted. The tap is opened to apply a vacuum of 500 mm. of mercury and closed when 200 ml. of fuel have passed through the filter into the graduated receiver. A PASS is recorded if the 200 ml. will pass through a given mesh size or a FAIL if the filter has become blocked.

A series of CFPP filter assemblies with filter screens of 10 um to 45 um including LTFT (AMS 100.65) and a Volkswagen Tank filter (part no. KA/4-270/65.431-201-511) both intermediate between 35 and 45 um are used to determine the finest mesh the fuel will pass.

Wax settling studies were also performed prior to filtration. The extent of the settled layer was visually measured as a % of the total fuel volume. Thus extensive wax settling would be given by a low number whilst an unsettled fluid fuel would be at a state of 100%. Care must be taken because poor samples of gelled fuel with large wax crystals almost always exhibit high values, therefore these results should be recorded as "gel".

In this Example the additives used were as follows:

Additive O

N N dihydrogenated tallow ammonium salt of 2 N $N^1$ dihydrogenated tallow benzene sulphonate.

Additive R

A copolymer of ethylene and vinyl acetate containing about 13.5 wt % vinyl acetate and having a number average molecular weight of 3500.

Additive S

A copolymer of ethylene and propylene containing 56 wt. % ethylene and of number average molecular weight of 50,000.

Additive T

The 1,2,4,5 tetra, N,N di(hydrogenated tallow) amido benzene was prepared by reacting 4 moles of dihydrogenated tallow amine with one mole of pyromellitic dianhydride in the melt at 225° in a flask containing a stirrer, temperature probes, Nitrogen purge and distillation condenser. Water was distilled out for approximately 8 hours and the product obtained.

Additives P and Y as used in Example 2

Various combinations of these additives were tested in distillate fuels E and F which had the following properties:

| | | | ASTM D86 Distillation (C.°) | | | | |
|---|---|---|---|---|---|---|---|
| Fuel oil | WAT | Wax Content | IBP | 20% | 50% | 90% | FBP |
| E | −3 | 1.9 | 190 | 246 | 282 | 346 | 374 |
| F | −4 | 1.2 | 178 | 234 | 274 | 341 | 372 |

The test results were as follows:

FUEL E

| Additives (ppm) | | | | | | Mesh Passed |
|---|---|---|---|---|---|---|
| Q | R | S | T | Y | P | at −9° |
| 250 | 250 | | 250 | 250 | | 10 mm |
| 250 | 250 | | 250 | | 250 | 15 mm |
| 250 | | 250 | 250 | 250 | | 15 mm |
| 250 | | 250 | 250 | | 250 | 10 mm |
| 250 | 250 | | | 250 | | 20 mm |
| 250 | 250 | | | | 250 | 20 mm |
| 250 | 250 | | 250 | 250 | | 15 mm |
| 250 | 250 | | 250 | | 250 | 15 mm |
| 250 | | 250 | | 250 | | 20 mm |
| 250 | | 250 | | | 250 | 15 mm |
| 250 | | 250 | 250 | 250 | | 15 mm |
| 250 | | 250 | 250 | | 250 | 15 mm |

FUEL F

| Q | R | S | T | Y | P | Mesh Passed at −13° C. |
|---|---|---|---|---|---|---|
| 250 | 250 | | | 250 | | 15 mm |
| 250 | 250 | | | | 250 | 15 mm |
| 250 | 250 | | 250 | 250 | | 15 mm |
| 250 | 250 | | 250 | | 250 | 15 mm |
| 250 | | 250 | | 250 | | 15 mm |
| 250 | | 250 | | | 250 | 15 mm |
| 250 | | 250 | 250 | 250 | | 15 mm |
| 250 | | 250 | 250 | | 250 | 10 mm |

EXAMPLE 4

Five $C_{14}$ styrene fumarate copolymers were prepared by copolymerising $C_{14}$ dialkyl fumarate and styrene under various polymerisation conditions and tested in the test used in Example 3 as additives in mixtures of 1:1:1 with Additives Q and R at a 750 ppm treat rate in a fuel having the following properties.

| | |
|---|---|
| Untreated CFPP (°C.) | −2 |
| Cloud Point (°C.) | −2 |
| Distillation (D86) | |
| IBP | 178 |
| 20% | 261 |
| 90% | 341 |
| FBP | 362 |

and compared with a similar mixture containing the styrene maleate copolymer additive Y, the polymers were produced by polymerising at 120° using tertiary butyl peroctoate as catalyst under a pressure of 40 psig for 60 minutes polymerisation time followed by 15 minutes soak, when used the solvent was cyclohexane.

The polymers and test results were as follows:

TABLE 3

| Solvent | | Mesh Passed | | | |
|---|---|---|---|---|---|
| Used | Styrene Addition | >40 um | 40 um | 35 um | 25 um |
| Yes | Continuous injection | | | x | |
| Yes | All at start | | | x | x |
| Yes | 20% at start 80% over 60 mins | | | x | |
| No | All at start | x | x | | |
| Reference Maleic Anhydride Copolymer | | x | x | | |

x = Test Passed

Showing improved performance for the products of the invention.

We claim:

1. A fuel composition comprising a major proportion by weight of a distillate fuel oil boiling in the range of 120° C. to 500° C. and a minor proportion by weight of an additive combination for modifying the shape and structure of wax crystals comprising (A) a copolymer of (1) an alpha olefin having 12 to 17 carbon atoms per molecule or an aromatic substituted olefin having 8 to 40 carbon atoms per molecule, and (2) an ester, said ester being a mono- or dialkyl fumarate, itaconate, citraconate, mesaconate, trans- or cis-glutaconate, in which the alkyl group has 10 to 18 carbon atoms; and (B) a co-additive which is pour point depressant copolymer of ethylene and vinyl acetate having a Mn of from 1,000 to 6,000 wherein the vinyl acetate comprises about 20 to about 40 wt. % of the copolymer.

2. A concentrate comprising a solvent containing 20 to 90 wt. % of a wax modifying copolymer of (A) (1) an alpha olefin having 12 to 17 carbon atoms per molecule or an aromatic substituted olefin having 8 to 40 carbon atoms per molecule and (2) an ester, said ester, being a mono- or di-alkyl fumarate, itaconate, citraconate, mesaconate, trans- or cis-glutaconate, in which the alkyl group has 10 to 18 carbon atoms; and (B) a co-additive which is pour point depressant copolymer of ethylene and vinyl acetate having a Mn of from 1,000 to 6,000 wherein the vinyl acetate comprises about 20 to about 40 wt. % of the copolymer.

3. The composition of claim 1 wherein said (A) (2) ester is a dialkyl fumarate.

4. The composition of claim 1 or 3 wherein the mole ratio of olefin to ester in component (A) is from 1:1.2 to 1.2:1.

5. The composition of claim 1 or 3 wherein the olefin of said (A) component is styrene.

6. The concentrate of claim 2 wherein the olefin is styrene.

7. The concentrate of claim 2 or 6 wherein said (A) (2) ester is a dialkyl fumarate.

8. The concentrate of claim 2 or 6 wherein the mole ratio of olefin to ester in component (A) is from 1:1.2 to 1.2:1.

* * * * *